United States Patent [19]

Taylor et al.

[11] 4,286,409

[45] Sep. 1, 1981

[54] TREE STAND

[76] Inventors: Neil J. Taylor, 5492 Cleo St.; A. Robert St. Hilaire, 331 Pearl Dr., both of Livermore, Calif. 94550; James L. Johnson, 340 N. Civic Dr., Walnut Creek, Calif. 94956

[21] Appl. No.: 87,260

[22] Filed: Oct. 22, 1979

[51] Int. Cl.[3] ..... A47G 33/12

[52] U.S. Cl. ..... 47/40.5; 248/527; 248/DIG. 10

[58] Field of Search ..... 47/40.5; 150/52 R; 206/423; 220/6, 7; 229/19, 22; 428/19, 35; 248/527, DIG. 10

[56] References Cited

U.S. PATENT DOCUMENTS

| | | | |
|---|---|---|---|
| 1,954,006 | 4/1934 | Wolf | 206/423 X |
| 2,243,080 | 5/1941 | Brogden | 229/22 X |
| 2,601,658 | 6/1952 | Bussert | 47/41.12 X |
| 2,771,260 | 11/1956 | Thom | 47/40.5 X |
| 2,934,204 | 4/1960 | Pardee | 206/423 |
| 3,033,505 | 5/1962 | Brown | 47/40.5 |
| 3,083,824 | 4/1963 | Ness | 206/423 |
| 3,250,454 | 5/1966 | Steiger | 229/22 |
| 3,954,129 | 5/1976 | Rudell et al. | 150/52 R |

*Primary Examiner*—Henry F. Epstein
*Attorney, Agent, or Firm*—Jack C. Munro

[57] ABSTRACT

A tree stand taking the form of a foldable sheet material housing having a planar base and a plurality of evenly spaced side wall members extending therefrom. The outermost end of each of the side wall members are to cooperate together to form an enclosed area. A support ring is to be located about the outermost ends forming a polygonal shaped enclosed area. Thread fasteners are to threadingly extend through the support ring into the enclosed area and are adapted to come into contact with the trunk of the supported tree which in turn extends within the formed interior chamber of the housing. The interior chamber of the housing includes a flexible walled water tight container within which is to be located a quantity of water. The free end of the trunk of the tree is to rest upon a resilient pad of material secured to the inside surface of the container located adjacent the base of the sheet material housing.

8 Claims, 3 Drawing Figures

TREE STAND

BACKGROUND OF THE INVENTION

The field of this invention relates to tree stands and more particularly to a tree stand which is to be primarily constructed of inexpensive sheet material, such as paper and is to be foldable when not in use.

The use of tree stands, especially to support Christmas trees has been well known. Prior to the present invention, all known types of tree stands were constructed of metal and are usually of a comlex construction which greatly magnifies manufacturing cost. There is a definite need for the construction of a Christmas tree stand which is composed of few parts and can be readily manufactured of inexpensive conventional materials so as to minimize the total purchasing price of the Christmas tree stand.

SUMMARY OF THE INVENTION

The structure of this invention is summarily described in the Abstract of the Disclosure and reference is to be had thereto.

The primary objective of this invention is to construct a Christmas tree stand from a sheet material such as paper, such material being readily available and quite inexpensive.

A further objective of this invention is to construct a Christmas tree stand which supports the trunk of the tree within a quantity of water so that the tree is capable of continually absorbing water thereby minimizing the potential fire hazard of the tree.

A further objective of this invention is to use the weight of the water located at the base of the tree as the weighted base to maintain the tree in the supported or erect position.

A further objective of this invention is to design the tree stand so as to be foldable when not in use.

Another objective of this invention is to construct a tree stand of very few parts in order to minimize total manufacturing cost.

DETAILED DESCRIPTION OF THE SHOWN EMBODIMENT

Figure 1:
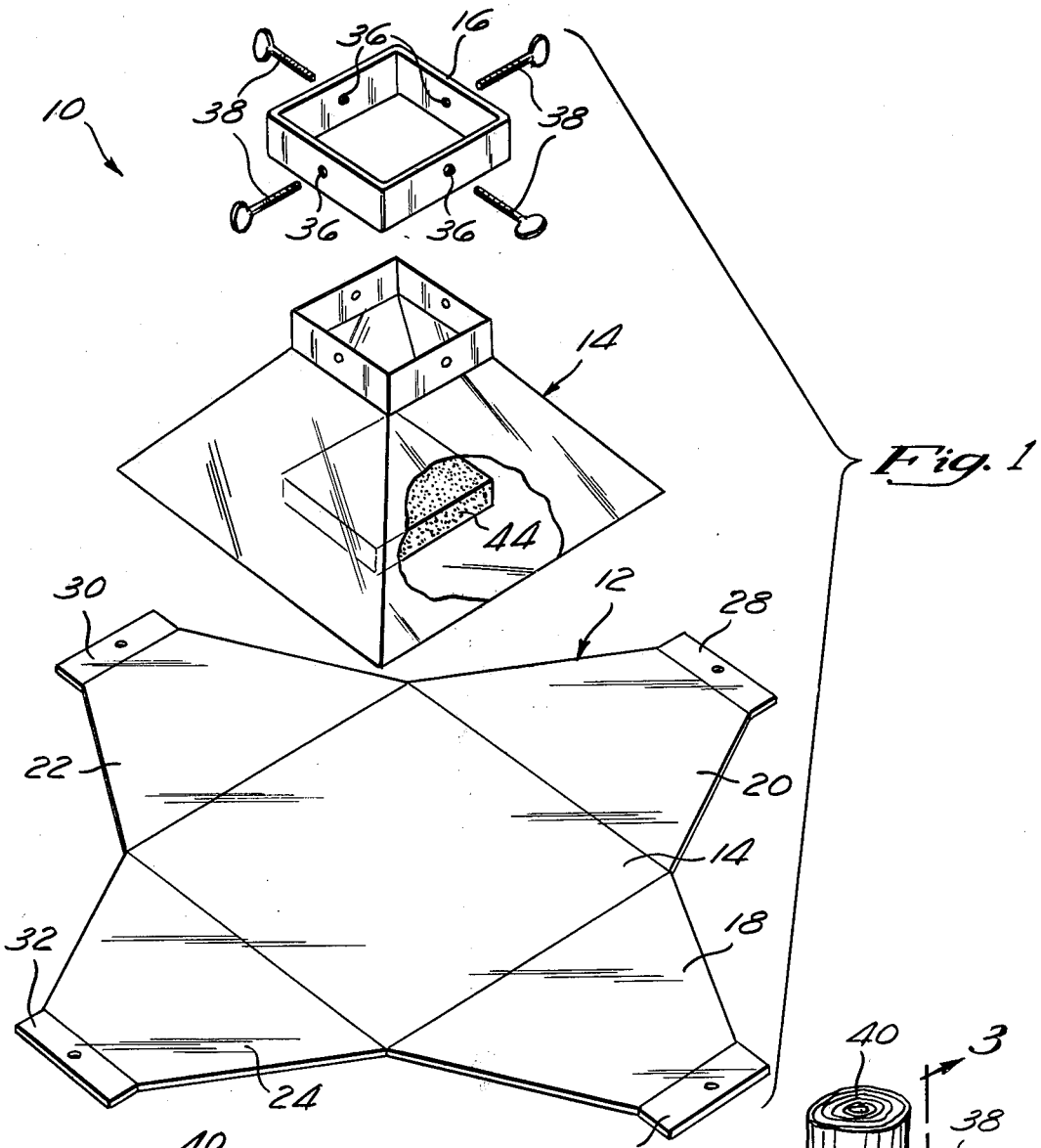
FIG. 1 is an exploded isometric view of the tree stand of this invention showing the sheet material housing in the disassembled or planar configuration.

Referring particularly to the drawing, there is shown the tree stand 10 of this invention which is composed primarily of a housing 12, a flexible walled container 14, and a support ring 16.

Figure 2:
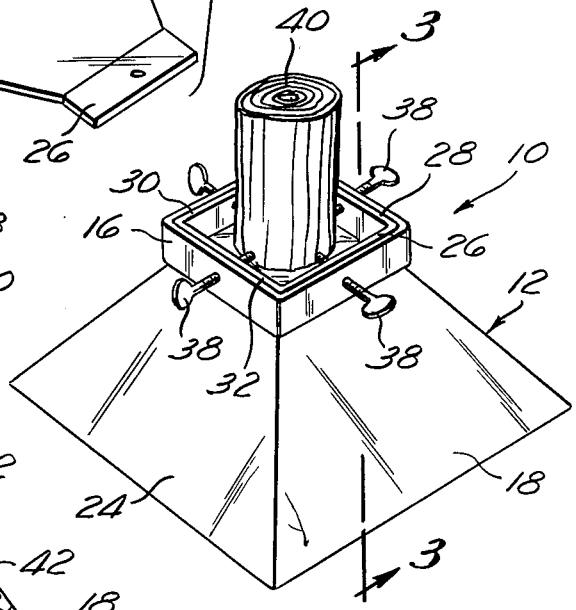
FIG. 2 is an isometric view showing the tree stand of this invention as it would be normally employed.
Figure 3:
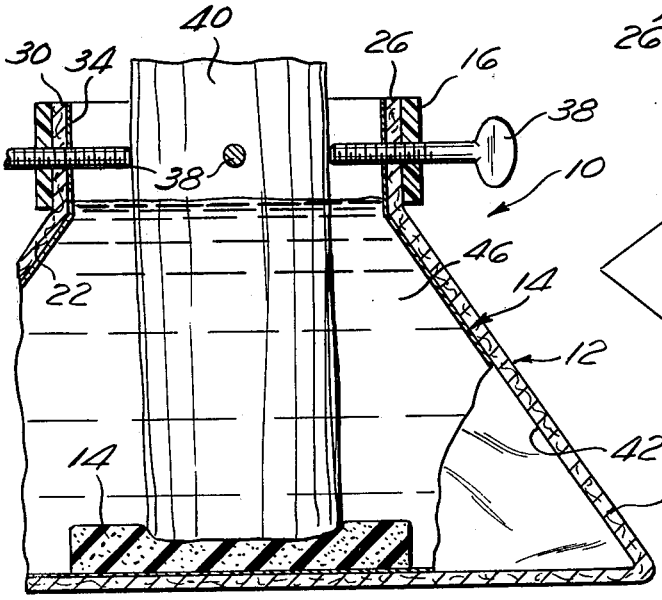
FIG. 3 is a cross-sectional view taken along line 3—3 of FIG. 2.

The housing 12 is composed of a square base 15. Extending from each side of the square base 15 are side members 18, 20, 22, and 24. Between each of the side members 18, 20, 22, and 24 and the base 15 is a scored line which facilitates folding of the side members to the position shown within FIG. 2 of the drawing. The desirable material of construction for the housing 12 will normally comprise 200 pound-strength cardboard, or other similar types of material. However, it is considered to be within the scope of this invention that any thin sheet material could be employed, such as a plastic.

The outermost ends 26, 28, 30 and 32 of the respective side members 18, 20, 22, and 24 are bendable in respect thereto. The outermost ends 26, 28, 30 and 32 are to cooperate together to form an enclosed area 34. When this enclosed area is formed, the side members 18, 20, 22, and 24 cooperate together to form a totally enclosed side. This is due to their initial shape.

Located about the outermost ends 26, 28, 30 and 32 is the support ring 16. This support ring 16 will normally be of a more rigid structure, such as a plastic, metal, or the like. The normal width of the ring 16 will be approximately one inch. The ring 16 is shown to be of a square configuration. However, other polygonal shaped configurations could be employed and also possibly even a circular configuration could be employed.

Within each side of the support ring 16 is an opening 36. Each opening 36 is internally threaded. A threaded fastener 38 is to be threadably secured within a respective opening 36. The threaded fasteners 38 are shown to be of what is denoted generally as a thumb screw. However, any conventional type of threaded fastener could be employed.

The threaded fasteners are to extend through the threaded openings 36 and into the enclosed area 34. The inner end of each of the fasteners 38 is adapted to become into physical contact with the trunk 40 of a tree. The trunk 40 is to extend through the enclosed area and into the interior chamber 42 formed by the inner surface of the side walls 18, 20, 22 and 24 and the upper surface or interior surface of the base 15. The free end of the trunk 40 is to rest against a pad 44 which is constructed of rubber, foam or the like. The pad 44 is attached to the interior surface of the flexible walled container 14 which in turn is secured to the upper surface (or interior surface) of the base 15.

The flexible walled container 14 will normally be constructed as an integral unit of plastic. The configuration of the container 14 will be basically identical to the configuration of the interior chamber 42. The purpose of the flexible walled container 14 is to provide water to the trunk 40 and also to provide a weight at the base of the tree tending to maintain the tree in an erect condition.

With the ring 16 located about the outermost members 26, 28, 30 and 32, the established usable configuration of the housing 12 is maintained. With the fasteners 38 extending through the ring 16 and through the outermost ends 26, 28, 30 and 32, as well as through the flexible walled container 14, the entire assembled unit is rigidly interconnected together.

It is envisioned that the tree stand 10 of this invention could be constructed inexpensively enough to qualify as a disposable type of tree stand. However, it is also considered to be within the scope of this invention to reuse the stand each year. During its non-use period, the water 46 would be removed and the fasteners 38 also removed, as well as the support ring 16, so that the tree stand 10 could be placed within a disassembled condition. In the disassembled state, the tree stand 10 of this invention will assume a small amount of space in order to facilitate storage.

What is claimed is:

1. A tree stand comprising:

a sheet material housing having a planar base and a plurality of spaced-apart side wall members attached to said base and extending therefrom, each said side wall member including an outermost member, said outermost members to be locatable to form an enclosing area spaced above said base and centrally disposed in relation thereto;

an interior chamber bounded by the inner surface of each of said side wall members and the upper surface of said base, a support ring located about said outermost members, securing means movably mounted on said support ring, said securing means being movable into said enclosing area and adapted to contact the trunk of the supported tree; and a flexible walled, water tight container located within said interior chamber, said container to be positioned against the inner surface of said side walls and the upper surface of said base, said container being adapted to be filled with a quantity of water causing said container to be tightly pressed against said side walls and said base to make available moisture to the truck of the supported tree and also provide sufficient weight at the base of the tree to keep the tree from tipping.

2. The tree stand as defined in claim 1 wherein:

said side wall members cooperating together to form a totally enclosing side wall assembly, said side wall members being evenly spaced apart.

3. The tree stand as defined in claim 1 wherein:

said support ring being polygonal shaped in cross-section along a plane perpendicular to the longitudinal center axis of the tree trunk thereby forming a polygonal shaped enclosing area.

4. The tree stand as defined in claim 1 wherein:

said securing means comprising a plurality of separate spaced-apart threaded fasteners, said threaded fasteners being threadably connected to said support ring.

5. The tree stand as defined in claim 1 wherein:

a pad of resilient material located within said interior chamber and attached to said container upon the upper surface of said base, said pad being adapted to support the cut end of the tree trunk.

6. The tree stand as defined in claim 5 wherein:

said side wall members cooperating together to form a totally enclosing side wall assembly, said side wall members being evenly spaced-apart.

7. The tree stand as defined in claim 6 wherein:

said support ring being polygonal shaped in cross section along a plane perpendicular to the longitudinal center axis of the tree trunk thereby forming a polygonal shaped enclosing area.

8. The tree stand as defined in claim 7 wherein:

said securing means comprising a plurality of separate spaced-apart threaded fasteners, said threaded fasteners being threadably connected to said support ring.

* * * * *